US005494061A

United States Patent [19]

Chan et al.

[11] Patent Number: 5,494,061

[45] Date of Patent: Feb. 27, 1996

[54] MULTIPLE PROTOCOL MULTIPLE PUMP LIQUID CHEMICAL DISPENSER

[75] Inventors: Wai Y. C. Chan; James W. Livingston, both of Santa Cruz, Calif.

[73] Assignee: Diversey Corporation, Mississauga, Canada

[21] Appl. No.: 475,855

[22] Filed: Jun. 7, 1995

Related U.S. Application Data

[62] Division of Ser. No. 265,493, Jun. 23, 1994, Pat. No. 5,453,131, which is a continuation of Ser. No. 967,174, Oct. 27, 1992, abandoned.

[51] Int. Cl.[6] ..... A47L 15/44

[52] U.S. Cl. ..... 134/57 D; 134/95.3

[58] Field of Search ..... 134/18, 25.2, 56 D, 134/57 D, 58 D, 95.3

[56] References Cited

U.S. PATENT DOCUMENTS

| | | | |
|---|---|---|---|
| 4,467,423 | 8/1984 | Smith et al. | 134/57 D |
| 4,561,904 | 12/1985 | Eberhardt, Jr. | 134/18 |
| 4,756,321 | 7/1988 | Livingston et al. | 134/56 D |
| 5,014,211 | 5/1991 | Turner | 364/478 |
| 5,056,542 | 10/1991 | Reinhard | 134/57 D |
| 5,448,115 | 9/1995 | Howland et al. | 134/57 D X |

*Primary Examiner*—Philip R. Coe

*Attorney, Agent, or Firm*—Flehr, Hohbach, Test, Albritton & Herbert

[57] ABSTRACT

A liquid chemical dispensing system for dispensing a plurality of liquid chemicals into a dishwasher includes at least a detergent pump and a rinse agent pump, a first switch indicating whether the dishwasher is a door type or a conveyor type dishwasher, a second switch indicating whether the controller is in training mode or in run mode, a non-volatile memory and a data processor. The liquid chemical dispensing system is powered on whenever the dishwasher is spraying rinse water. In the training mode, the data processor enables a user to set values for a rinse run time parameter, a detergent run time parameter, and a rinse delay time, and stores those parameters in the non-volatile memory. In the run mode for door type dishwashers, each time the system is powered on the data processor runs the detergent pump a length of time corresponding to the stored detergent run time parameter, delays running the rinse pump, from the time of each power on, by an amount of time corresponding to the stored rinse delay time parameter, and then runs the rinse pump a length of time corresponding to the stored rinse run time parameter. In the run mode for conveyor type dishwashers, the data processor runs the rinse pump each time the system is powered on, and runs the detergent pump for N seconds for each M seconds that the rinse pump is run, where N is the detergent run time parameter and M is a predefined value.

13 Claims, 6 Drawing Sheets

MULTIPLE PROTOCOL MULTIPLE PUMP LIQUID CHEMICAL DISPENSER

This application is a divisional continuation of Ser. No. 08/265,493, filed Jun. 23, 1994, issued as U.S. Pat. No. 5,453,131, which was a continuation of Ser. No. 07/967.174, filed Oct. 27, 1992, abandoned.

The present invention relates generally to liquid chemical dispensers for commercial dishwashers and other machines, and particularly to the control circuitry used for controlling multiple chemical dispensing pumps.

BACKGROUND OF THE INVENTION

Many prior art chemical dispensers for commercial dishwashers use conductivity probes to determine when detergent should be added to the "bath" of water used by the dishwasher. While this is desirable, such chemical dispensers are both expensive and require sophisticated personnel for proper installation, and thus such chemical dispensers are economically worthwhile only for dishwashers that process very high quantities of dishes, and thus use large quantities of chemicals. U.S. Pat. No. 4,756,321 is an example of a dishwasher chemical dispenser that uses a conductivity probe. Another prior art chemical dispenser for commercial dishwasher is shown in U.S. Pat. No. 4,509,543 (Livingston et al.). For the purposes of providing background information regarding commercial dishwashers and controllers, U.S. Pat. Nos. 4,509,543 and 4,756,321 are hereby incorporated by reference.

The prior art also includes various "probeless" chemical dispensers for commercial dishwashers. This class of chemical dispensers typically is used with smaller volume dishwashers. The controllers for most such chemical dispensers are hardwired circuits designed to implement a single dispensing protocol.

It is typical of most dishwasher liquid chemical dispenser controllers that the controller receives electrical power indirectly from the dishwasher only when the dishwasher is running. More particularly, in the typical controller, the part of the controller for running each pump is powered on only when a corresponding signal from the dishwasher's sequencer is active. For instance, in some controllers the control circuitry for running the rinse agent pump would receive power only when the rinse (i.e., fresh) water solenoid valve in the dishwasher was open, and the control circuitry for running the detergent pump would receive power only when the water tank pump (for recycling water from the dishwasher's water tank through the sprayer arms) was on.

While this may not have been viewed as a problem in the past, the above mode of powering the controller is expensive because the controller requires multiple signals from the dishwasher's sequencer, and for each such signal from the dishwasher's sequencer the controller would require a separate transformer.

It is an object of the present invention to provide a chemical dispenser controller that can be used with both door type and conveyor type dishwashers, and that can be trained or programmed at the site of the dishwasher to perform the chemical dispensing protocol required by that dishwasher. It is a related object of the present invention to provide a single probeless liquid chemical dispenser controller than can replace many, if not all, of the existing multiple models of probeless controllers.

SUMMARY OF THE INVENTION

In summary, the present invention is a liquid chemical dispensing system for dispensing a plurality of liquid chemicals into a dishwasher. The liquid chemical dispensing system includes a plurality of pumps, including a detergent pump and a rinse agent pump, and a controller that includes a first switch indicating whether the dishwasher is a door type or a conveyor type dishwasher, a second switch indicating whether the controller is in training mode or in run mode, a non-volatile memory and a data processor. The liquid chemical dispensing system is powered on only when the dishwasher is spraying rinse water.

When the second switch is in the training mode position, the data processor enables a user to set values for a rinse run time parameter, an initial detergent run time parameter, a maintenance detergent run time parameter, and a rinse delay time parameter, and stores those parameters in the non-volatile memory.

When the second switch is in the run mode position, and the first switch is in the door type position, the controller works as follows. Each time the system is powered on the data processor runs the detergent pump a length of time corresponding to a first stored detergent run time parameter, delays running the rinse pump after each power on by an amount of time corresponding to the stored rinse delay time parameter, and then runs the rinse pump a length of time corresponding to the stored rinse run time parameter. If the dishwasher's rinse water continues to run longer than a predefined amount of time, such as twenty seconds, this indicates that the dishwasher's wash water tank has been emptied and is in the process of being refilled. When this condition is detected, by monitoring the length of time the rinse water flows, the system runs the detergent pump a length of time corresponding to a second stored detergent run time parameter.

When the second switch is in the run mode position, and the first switch is in the conveyor type position, the data processor runs the rinse pump each time the system is powered on, and runs the detergent pump with an on/off duty cycle determined by the stored detergent run time parameter. More particularly, when running in conveyor mode, the data processor stores a rinse run time value in the non-volatile memory. The data processor retrieves the rinse run time value from the non-volatile memory each time that the dispensing system is powered on. As long as the system remains powered on, the data processor periodically updates the rinse run time value and also runs the detergent pump at times determined in accordance with the rinse run time value and the detergent run time parameter. For instance the data processor will run the detergent pump for N seconds for each M seconds that the rinse pump is run, where N is the detergent run time parameter and M is a predefined value.

The data processor stores specified values at specified locations in the non-volatile memory, including a pointer indicating a location in the non-volatile memory where the updated rinse run time value is stored each time that the dispenser's controller is powered down. When the non-volatile memory is an EEPROM whose memory cells are guaranteed to work properly for up to a predefined number of write cycles, the data processor also stores in the non-volatile memory at another location corresponding to the pointer an update data value indicating how many times the updated rinse run time value has been stored in the non-volatile memory. When the update data value reaches a predefined value, such as 50,000 updates, the data processor updates the pointer stored in the non-volatile memory so as to indicate a different location in the non-volatile memory than the location previously indicated by the stored pointer. In this way, no location in the non-volatile memory is written to more than the predefined number of times.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
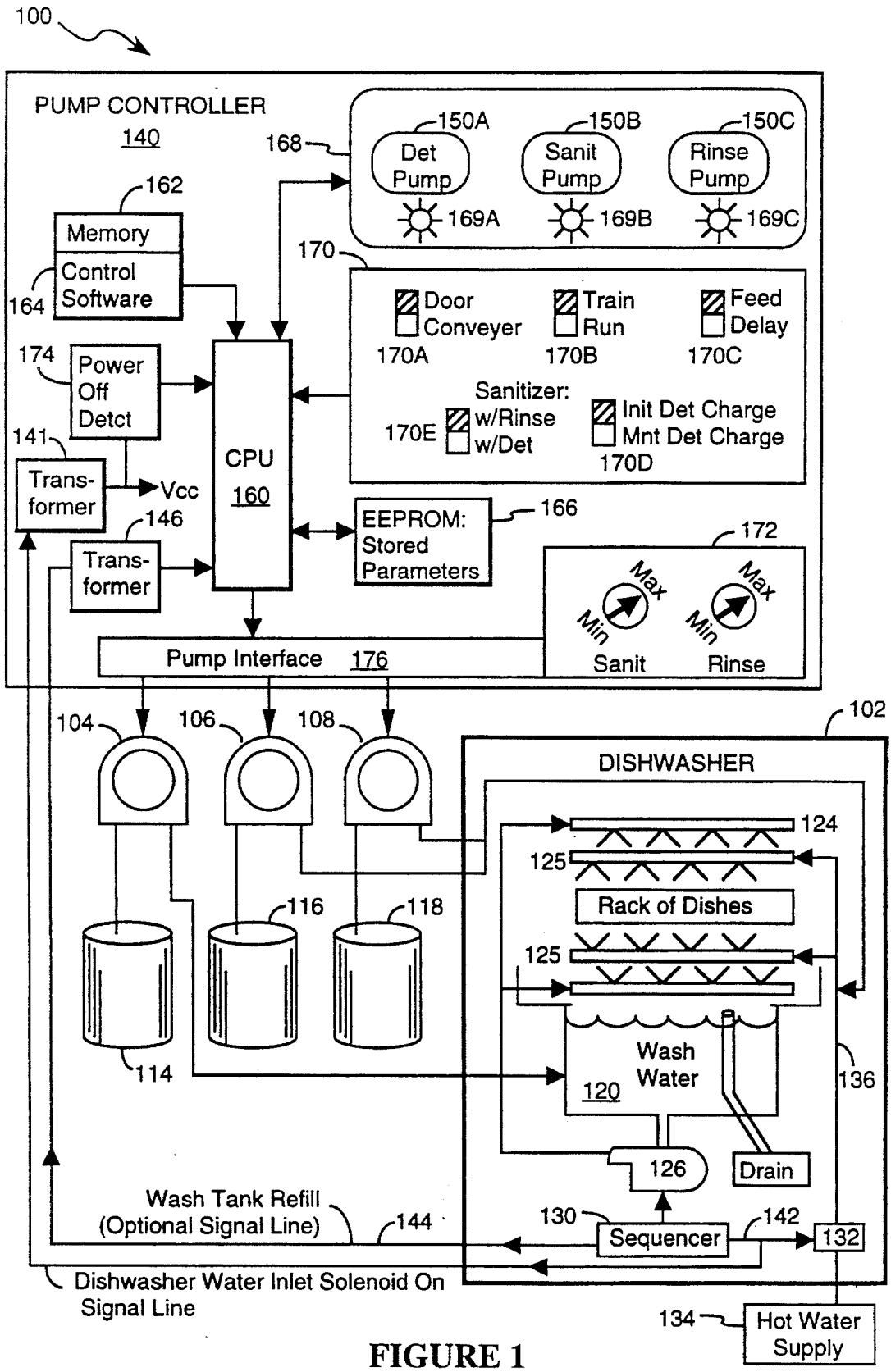
FIG. 1 is a block diagram of a dishwasher system including a liquid chemical dispenser with a controller in accordance with the present invention.

Referring to FIG. 1, a dishwasher system 100 in accordance with the present invention includes a dishwasher 102, which can be either a door type or conveyor type dishwasher, pumps 104, 106 and 108 for delivering corresponding chemicals from containers 114, 116 and 118 to the dishwasher 102. In the example shown in FIG. 1, container 114 holds liquid detergent, container 116 holds rinse agent and container 118 holds a sanitizer chemical such as bleach or other antibacterial chemical. For convenience, the corresponding pumps will be called the detergent pump 104, the rinse agent pump 106 and the sanitizer pump 108. In the preferred embodiment all three pumps are peristaltic pumps of the type disclosed in patent application Ser. No. 07/967.713, filed Oct. 27, 1992, now abandoned, entitled Peristaltic Pump. However, many other types of peristaltic pumps could be used in the system 100, so long as the pumping capacities of the pumps are properly selected. The detergent pump 104 typically has a pumping capacity of 150 to 250 ml/minute pump, the rinse agent pump 106 typically has a pumping capacity of 2 to 20 ml/minute, and the sanitizer pump 108 typically has a pumping capacity of 150 to 250 ml/minute. Note that the same model pump head can be used for all three pumps, with the different pumping capacities being achieved by using different sizes of pump tubing and different pump motors.

The detergent pump 104 adds detergent into the dishwasher's wash water tank 120, while the rinse agent pump 106 dispenses rinse agent into the clean rinse water in water line 122. Sanitizer is typically used only in "low temperature" dishwashers with rinse water temperature below 160 degrees Fahrenheit. Furthermore, sanitizer may be dispensed either into the rinse water or the wash water tank, although in FIG. 1 it is shown as being dispensed into the rinse water in water line 122. Thus, high temperature dishwasher systems will typically have only two pumps (for detergent and rinse agent) while low temperature dishwasher systems will typically have three pumps.

The dishwasher 102 can be either a door type dishwasher (sometimes called a batch type dishwasher) or a conveyor type dishwasher. In either type of dishwasher the dishes are first sprayed, via sprayer arms 124, with recycled wash water from tank 120 for a period typically ranging between forty-five seconds and one minute thirty seconds. The wash water in tank 120 contains detergent to assist sanitizing the dishes. A wash water pump 126 is used to draw wash water from tank 120 and pump it into the sprayer arms 124. The action of the wash water pump 126 agitates the water in the tank 120, thereby promoting proper mixing of the detergent added to the tank.

After the initial wash cycle, the dishes are sprayed by with clean, hot rinse water, via sprayer arms 125.

In a door (or batch) type dishwasher, one or more racks of dished are placed in the dishwasher, cleaned, and then removed from the dishwasher before the next racks of dishes are washed. In a conveyor type dishwasher racks of dishes travel on a conveyor through two sections: a wash section and a rinse section.

Door type dishwashers generally include a sequencer 130 that turns on the wash water pump 126 during the machine's wash cycle and opens the rinse water control solenoid 132 during the rinse cycle to allow water from a hot water supply 134 to flow into the machine's rinse water line 136. Therefore these basic timing functions are provided by the dishwasher's built in sequencer 130 rather than the controller 140 for the liquid chemical dispenser, described below. In conveyor type dishwashers the wash water pump is always on when the dishwasher is active, but the rinse water solenoid 132 is activated only when a sensor arm in the rinse section detects the presence of a rack of dishes.

In both door type and conveyor type dishwashers, the signal on line 142 used to open the rinse water solenoid valve 132 is typically a 115 or 208 volt a.c. signal. In one preferred embodiment, this signal is coupled to a transformer 141 in the pump controller 140 for the purpose of providing power to both the controller 140 and the pumps 104, 106, 108. A first stage of the transformer 141 outputs a 24 volt a.c. signal for use by the pumps and a second stage of the transformer 141, which includes a rectifier, outputs a 5 volt d.c. signal for powering the control circuitry.

In the preferred embodiment, the only signal line connecting the dishwasher 102 to the controller 140 is the rinse water solenoid control line 142. However, in alternate embodiments an additional signal line 144 would also be connected from the dishwasher 102 to the controller 140, where the additional signal line 144 carries an active signal only when the wash water tank 120 has been emptied and is in the process of being refilled. In the preferred embodiment, the user is required to push the detergent pump button 150A (on the front panel of the controller) each time the wash water tank 120 is refilled, causing the controller to dispense an initial charge of detergent into the wash water tank 120. The advantage of having the additional connection line 144 is to make the process of dispensing additional detergent in to the wash water tank 120 automatic, but the disadvantage of this additional line is that it makes installation of the controller more complex and makes the pump controller more expensive due to the provision of an additional transformer 146.

LIQUID CHEMICAL DISPENSER CONTROLLER

The controller 140 of the preferred embodiment includes a microcontroller 160, read only memory 162 for storing the control software 164 executed by the microprocessor (CPU) 160, and non-volatile memory 166 for storing parameters that control the dispenser's operation. In the preferred embodiment the microprocessor 160 is a Microchip PIC16C54, an 8-bit microprocessor made by Microchip Technology Inc.

A user interface 168 includes three buttons 150A–150C for priming corresponding ones of the pumps and three LEDs 169A–169C that are turned on when each of the pumps is running. The controller 140 in the preferred embodiment includes a housing (not shown) that encloses both the printed circuit board on which the controller's circuit 140 is mounted and the motors for the pumps, with the user interface 168 positioned on a front panel of the housing for easy user access. The controller's printed circuit board is attached to a top panel of the controller housing, and the top panel of the housing is hinged to provide access to a set of mode control switches 170 and a set of motor speed control dials 172.

The motor speed dials 172 are potentiometers that control the motor speeds for the sanitizer and rinse agent pumps, while signals sent by the CPU 160 to a pump interface 176 turn the pumps on and off. Pump interface 176 contains the driver circuitry for running the pump motors. The motor speed dial for the sanitizer and rinse agent pumps are adjusted by the person installing the system so that the proper amount of rinse agent and sanitizer are dispensed onto each rack of dishes. In the preferred embodiment, detergent pump does not have a motor speed dial, and thus that pump's motor is set to run at fixed speed.

The mode control switches 170 on the controller's printed circuit board include a first two-position switch 170A indicating whether the type of dishwasher that the controller is to be used with is a door type dishwasher or a conveyor type dishwasher. A second switch two-position switch 170B determines whether the controller is in training mode or run mode. A third two-position switch 170C is used during training mode to indicate whether the user is specifying (A) feed times for the detergent and rinse pumps or (B) a delay time for the rinse pump. A fourth two-position switch 170D is used, when switch 170C is in the "Feed" position, to indicate whether the user is specifying the amount of detergent to be dispensed into the dishwasher's wash water tank 120 when the tank is refilled with fresh water (i.e., when the switch 170D is in the "Init Det Charge" position) or is specifying the amount of detergent to be dispensed into the dishwasher's wash water tank 120 for maintaining the detergent concentration in the tank. Finally, a fifth two-position switch 170E indicates whether the sanitizer pump (if one is provided) should run at the same time as the detergent pump or at the same time as the rinse pump.

The controller 140 also includes power down detection circuit 174 that generates a power fail interrupt signal whenever the power supply to the board is turned off. The power fail interrupt signal is generated at least 10 milliseconds before the power supply voltage declines to the point that continued operation of the CPU 160 and EEPROM 166 can no longer be guaranteed. The power fail interrupt signal is used by the controller 140 to start execution of a short routine that stores status information in the EEPROM 166 when the dishwasher 102 is a conveyor type dishwasher. The power fail detection circuit 174 may be implemented with any number of well known circuits, one example of which is the Max690 made by Maxim Integrated Products Inc.

EEPROM MEMORY MAP

Figure 2:
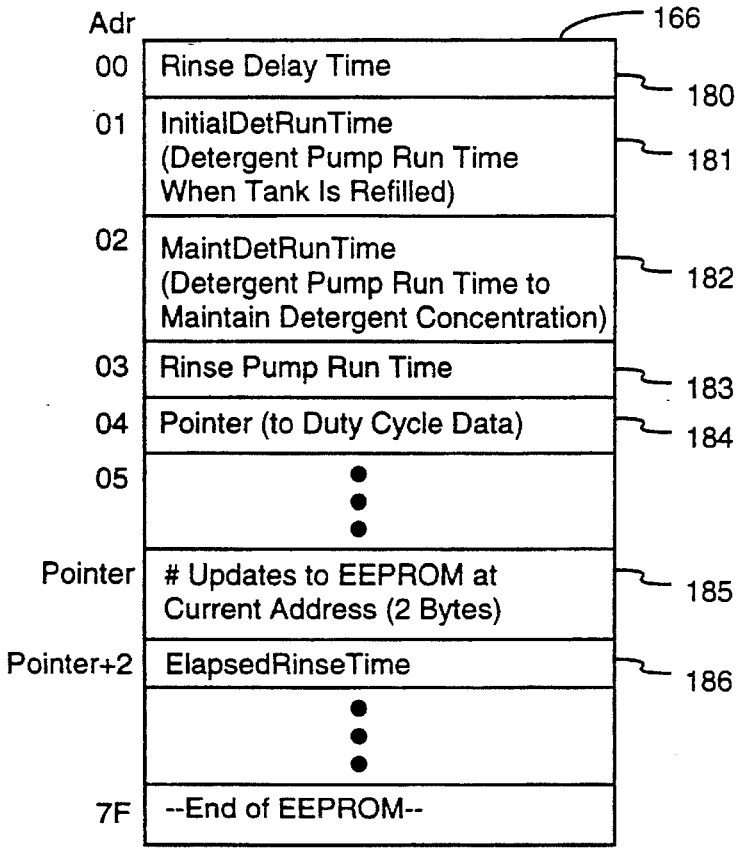
FIG. 2 depicts a memory allocation map for the EEPROM non-volatile memory used in the preferred embodiment of a liquid chemical dispenser controller.

Referring to FIG. 2, the non-volatile memory 166 in the preferred embodiment is an EEPROM such as the XICOR 24C01, which has a storage capacity of 128 bytes and is made by XICOR Inc. Each memory location in the EEPROM 116 in the preferred embodiment is guaranteed to be capable of being written at least 100,000 times, and the amount of time required to write one byte of data to the EEPROM 166 is less than 0.5 milliseconds.

The EEPROM 166 is used to store three parameters that control the operation of the liquid chemical dispenser, as well as three additional parameters for conveyor type dispensers. In the preferred embodiment, the EEPROM's available address space is divided into one-byte slots as follows:

Rinse Delay Time (called RinseDelayTime in the control software) 180, used only for door type dishwashers, is the number of seconds the controller delays after rinse water begins to flow in the dishwasher before turning on the rinse pump.

InitialDetRunTime (Detergent Pump Run Time when tank is refilled) 181 is the number of seconds the controller runs the detergent pump when the wash water tank is refilled, as will be explained in more detail below.

MaintDetRunTime (Detergent Pump Run Time for maintaining detergent concentration in water tank) 182. For door type dishwashers, the detergent pump runs for MaintDetRunTime each time the rinse water is turned on. For conveyor type dishwashers, the detergent pump is run for MaintDetRunTime for every 20 seconds of rinse water run time. Thus, for conveyor type dishwashers, the Detergent Pump Run Time parameter 182 determines the on/off duty cycle of the detergent pump.

Rinse Pump Run Time (called RinseRunTime in the control software) 183, used only for door type dishwashers, is the number of seconds the controller runs the rinse pump each time the rinse water in the dishwasher is turned on.

Pointer 184 points to the location in the EEPROM where the #Updates and ElapsedRinseTime parameters are stored. That is, Pointer is the address of the first byte of the #Updates value.

#Updates 185 is a two-byte integer value that indicates the number of times the ElapsedRinseTime value has been updated while being stored at its current EEPROM address. Note that the maximum possible value of a two-byte value is 65,535.

ElapsedRinseTime 186 is the cumulative amount of time the Rinse Water has run in this dishwasher, modulo 20 seconds. That is, if one kept track of the total run time for rinse water in the dishwasher, and divided that value by 20 seconds, the remainder of that division operation is what is stored as the ElapsedRinseTime.

The EEPROM 166 is preloaded with default values when the controller is first assembled. For instance, the first five bytes (at addresses 00 through 04) could all be preloaded with a value of "5", and all the other bytes of the EEPROM could be preloaded with a value of "0". In this way, the pointer 184, ElapsedRinseTime 186 and other parameters will all have reasonable initial values when the controller is first powered on.

CHEMICAL DISPENSING PROTOCOLS

The operation of the dishwasher system 100 is somewhat different for door type dishwashers and conveyor type dishwashers.

Figure 3:
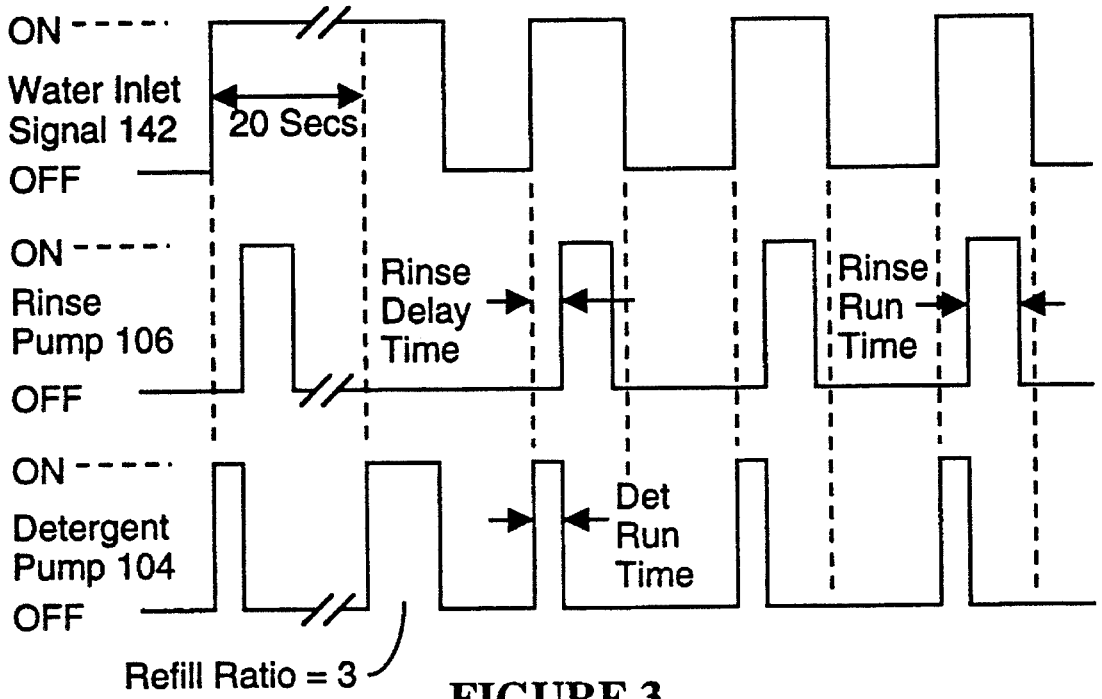
FIG. 3 is a timing diagram showing detergent and rinse pump activation by the controller of the present invention for door type dishwashers.

Door Type Pump Control. Referring to the timing diagram in FIG. 3 for door type dishwashers, each time the rinse water inlet signal turns on, the detergent pump runs for a length of time equal to MaintDetRunTime. Furthermore, each time the rinse water turns on, after a delay of RinseDelayTime the rinse pump runs for a length of time equal to RinseRunTime. For instance, the detergent pump might run for three seconds at the beginning of each rinse cycle, and the rinse pump might run for three seconds after a four second delay.

The only remaining feature of the control strategy for door type dishwashers is that the controller can automatically detect a wash tank refill by detecting a rinse cycle that exceeds a predefined period of time, such as twenty seconds, which is permanently coded into the control software. When this happens, the controller turns on the detergent pump for a period time equal to InitialDetRunTime.

In addition, whenever the user presses the detergent button 150A on the front panel during a rinse cycle, the controller will turn on the detergent pump for a period of time equal to InitialDetRunTime.

Figure 4:
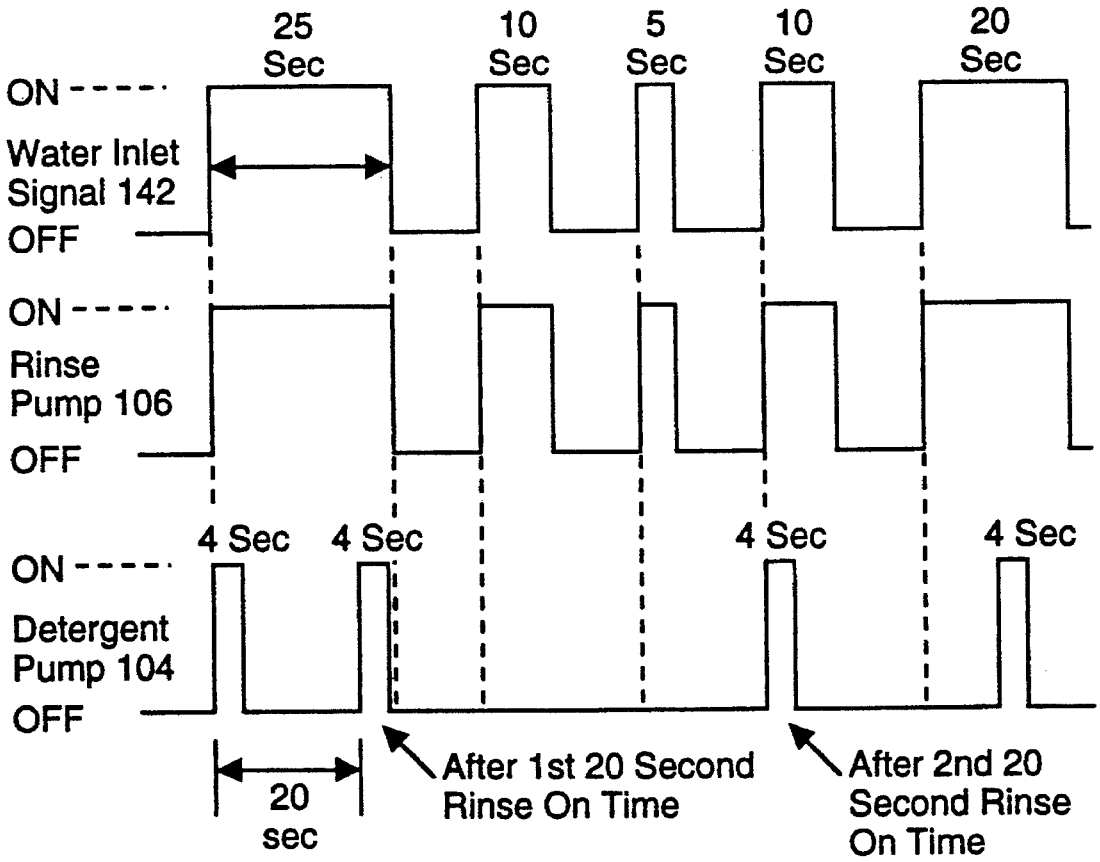
FIG. 4 is a timing diagram showing detergent and rinse pump activation by the controller of the present invention for conveyor type dishwashers.

Conveyor Type Pump Control. Referring to the timing diagram in FIG. 4 for conveyor type dishwashers, the rinse pump is run whenever the rinse water inlet signal is on. The detergent pump is run at a specified on/off duty cycle, defined as a certain run time for the detergent pump for each 20 seconds of rinse cycle operation. Thus, every time 20 seconds of rinse water run time elapses, the controller 140 runs the detergent pump for a length of time equal to MaintDetRunTime. For conveyor type dishwashers, the RinseDelayTime and RinseRunTime parameters are not, used in the preferred embodiment.

If the dishwasher has an automatic wash water tank dump and refill operation, and a corresponding signal is connected from the dishwasher to the controller 140, the controller can automatically detect a wash tank refill from that signal. When a refill is detected, or when the user pushes the Detergent button 150A on the front panel, the controller turns on the detergent pump for a period time equal to InitialDetRunTime, as discussed above.

CONTROL PROGRAM

Figure 6B:
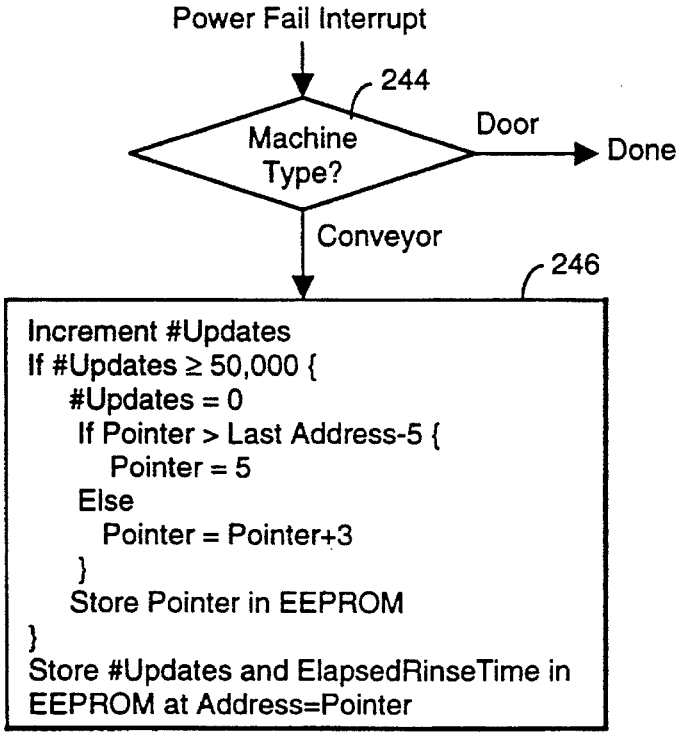
FIGS. 6A and 6B are a flow chart of the run mode portions of the control program used in the preferred embodiment of the present invention.
Figure 5:
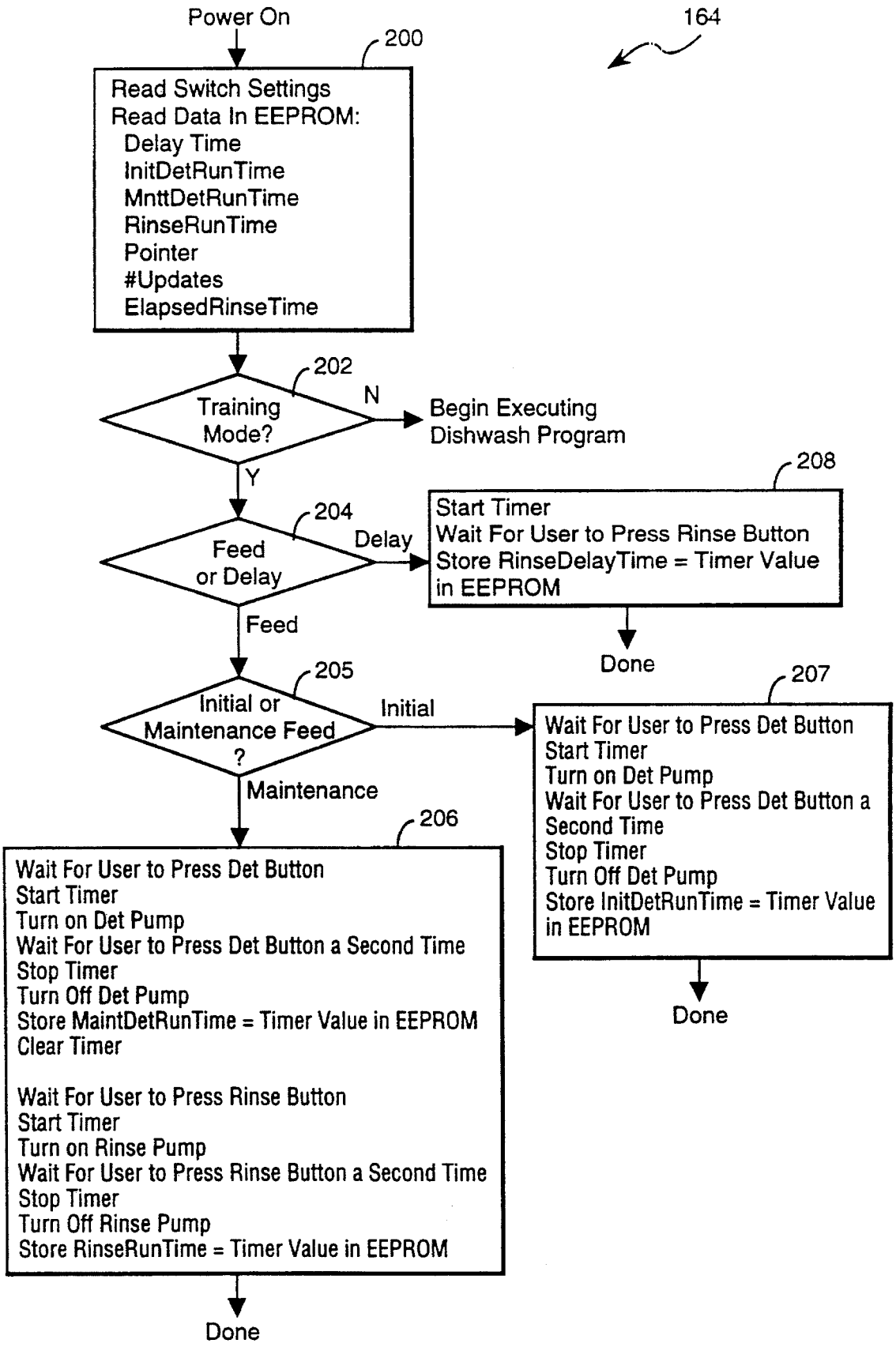
FIG. 5 is a flow chart of the power on and training mode portions of the control program used in the preferred embodiment of the liquid chemical dispenser controller of the present invention.
Figure 6A:
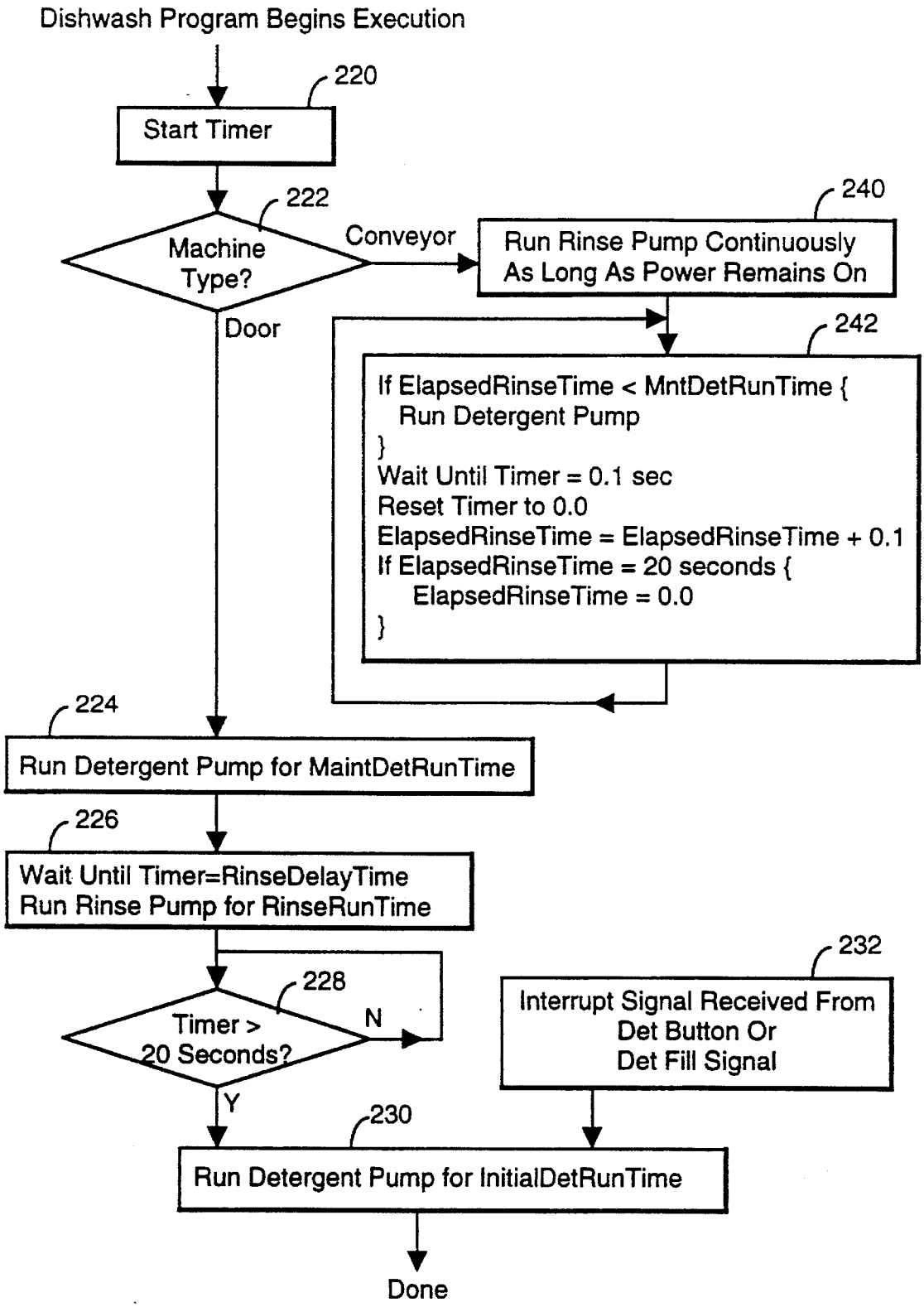

Referring to FIGS. 5, 6A and 6B, each time the controller is powered on (i.e., each time the dishwasher begins to spray rinse water), the controller begins execution of its control program 164 (at box 200). The first steps of the control program are to read the settings of the switches 170A to 170E, and also to read in from the EEPROM the following parameter values: RinseDelayTime, InitialDetRunTime, MaintDetRunTime, RinseRunTime, Pointer, #Updates, ElapsedRinseTime.

Next, the program determines whether controller is in training mode or program execution mode (box 202) from the position of switch 170B, which was read in step 200.

Training Mode. If the controller is in training mode, switch 170C is in the "FEED" position (box 204), and switch 170D is in the "Mnt Det Charge" position (box 205), the user trains the controller (box 206) to run the detergent and rinse pumps for the appropriate lengths of time as follows. While running the dishwasher, the user first presses the detergent button 150A to start the detergent pump and presses the detergent button 150A a second time to stop the detergent pump after the appropriate amount of detergent has been dispensed. The control program stores the amount of time that the detergent pump was run in memory location 182 of the EEPROM. The stored detergent pump run time parameter is herein called DetRunTime.

Next (still at box 206), while the dishwasher is still running, the user presses the rinse button 150C to start the rinse pump and presses the rinse button 150C a second time to stop the rinse pump after the rinse pump has been allowed to run an appropriate amount of time. The control program stores the amount of time that the rinse pump was run in memory location 183 of the EEPROM. The stored rinse pump run time parameter is herein called RinseRunTime. For conveyor type dishwashers, there is no need for the user to specify a rinse pump run time.

Note that except when the entire dishwasher's wash water tank is refilled, the only clean water added to the tank is the rinse water used to rinse each rack of dishes. That added rinse water causes the water tank to overflow, with excess water being directed to a drain. Since the addition of rinse water dilutes the detergent in the wash water tank, a small amount of detergent needs to be added to the tank on a regular basis so as to maintain a reasonable detergent concentration level. For door type dishwashers, the recorded MaintDetRunTime is the amount of time that the detergent pump is to be run for each rack of dishes, while for conveyor type dishwashers the recorded MaintDetRunTime is the amount of time that the detergent pump is to be run for each 20 seconds of rinse water run time.

To set the detergent pump run time for adding an initial amount of detergent when the dishwasher's water tank is refilled, the controller is put in training mode, switch 170C is set to the "FEED" position (box 204), and switch 170D is set to the "Init Det Charge" position (box 205). While running the dishwasher, the user first presses the detergent button 150A to start the detergent pump and presses the detergent button 150A a second time to stop the detergent pump after the appropriate amount of detergent has been dispensed. The control program stores the amount of time that the detergent pump was run in memory location 182 of the EEPROM. See box 207. The stored detergent pump run time parameter is herein called DetRunTime.

If the controller is in training mode, and switch 170C is in the "DELAY" position (box 204), the user trains the controller (box 208) to delay a specified period of time before running the rinse pump as follows. Since the delay parameter is needed only for door type dishwashers, this training step is not performed for conveyor type dishwashers. While running the dishwasher, the user waits for the rinse cycle to begin, and then presses the rinse button 150C. The control program stores the amount of time between the start of the rinse cycle and the time the user pressed the rinse button 150C in the slot 180 of the EEPROM. The stored delay time parameter is herein called RinseDelayTime.

To summarize, to program or train the controller, the user sets the train/run switch 170B to "train", sets the feed/delay switch 170C to "feed", and sets mode switch 170D to "Mnt Det Charge". Then, while running the dishwasher, the user uses the detergent button 150A to indicate the appropriate run time for the detergent pump and uses the rinse button 150C to indicate the appropriate run time for the rinse pump. To program an initial detergent run time for use when refilling the wash water tank, the user sets the feed/delay switch 170C to "feed", sets mode switch 170D to "Init Det Charge", and the uses the detergent button 150A to indicate the appropriate run time for the detergent pump. Next, the user sets the feed/delay switch 170C to "delay" and then, while again running the dishwasher, the user presses the rinse button 150C to indicate the delay time for the rinse pump. The control program monitors the switch settings and the detergent and rinse buttons to determine the timing values for MaintDetRunTime, InitDetRunTime, RinseRunTime and RinseDelayTime, and stores those values in the EEPROM.

Program Run Mode. If the controller is in program run mode (box 202), the controller starts a software timer (box 220) to keep track of how long the current rinse cycle has been running (box 220). If switch 170A indicates that the dishwasher is a door type dishwasher (222), the controller runs the detergent pump for a time period of MaintDetRunTime at the beginning of the rinse cycle (box 224). The controller waits until the timer value equals the RinseDelayTime value, and then runs the rinse pump for a time period of RinseRunTime (box 226).

If the timer value reaches a value of twenty seconds, or any other predefined time limit that indicates a tank refill operation is taking place (box 228), then the controller runs the detergent pump for a period of time specified by the stored InitialDetRunTime parameter (box 230).

In addition, whenever the controller is in run mode and the detergent button 150A is pressed or a detergent fill signal is received (if such a connection were provided from the dishwasher's sequencer), an interrupt signal is generated (step 232), causing the controller to run the detergent pump for a period of time equal to InitialDetRunTime (box 230). This latter method of recharging the wash water tank with detergent applies to both door type and conveyor type dishwashers.

Note that the sanitizer pump 108, if provided, will run at the same time as the detergent pump 104 or as the same time as the rinse pump 106, as determined by the setting of switch 170D.

If switch 1 70 A indicates that the dishwasher is a conveyor type dishwasher (box 222), the controller runs the rinse pump continuously (box 240) as long as the controller power remains on (i.e., as long as rinse water continues to run in the dishwasher). To control the detergent pump, an elapsed rinse time value ElapsedRinseTime is maintained (box 242). Once each tenth of a second the ElapsedRinseTime value is incremented, and whenever ElapsedRinseTime reaches a value of 20 seconds it is reset to zero. While ElapsedRinseTime has a value of less than MaintDetRunTime, the controller runs the detergent pump.

Referring to FIG. 6B, whenever the power off detection circuit 174 (shown in FIG. 1) generates a power fail interrupt signal, if the controller is connected to a conveyor type dishwasher (box 244), the controller then stores the ElapsedRinseTime value in the EEPROM (box 246). The procedure for doing this is made complex by the fact that EEPROM devices are usually guaranteed to still operate properly only for a specified number of writes to each memory location. The EEPROM used in the preferred embodiment is guaranteed for 100,000 writes per memory location.

If a conveyor type dishwasher is used to wash, say, as many as 500 racks of dishes per day, 365 days per year, the controller could write the ElapsedRinseTime value to the EEPROM as many as 182,500 times per year (i.e., 500 multiplied by 365), or as many as 2,737,500 times in fifteen years, which is the maximum expected lifetime of the controller. For this worst-case scenario, at least 28 different EEPROM memory locations must be used to store the ElapsedRinseTime value, and also the control program must be provided with a mechanism for rotating the memory location used over time. In the preferred embodiment, the number of updates to the current EEPROM memory location for the ElapsedRinseTime value is called #Updates and is stored in two bytes in the EEPROM. Each time a power fail interrupt occurs, the #Updates value is incremented. If #Updates is greater than or equal to 50,000, the Pointer is updated and #Updates is reset to zero. Then #Updates and ElapsedRinseTime are stored in the positions in the EEPROM corresponding to the current value of Pointer. When using an EEPROM with a capacity of 128 bytes, there are forty-one available three-byte slots for storing #Updates and ElapsedRinseTime. By cycling through these available slots twice (50,000 updates per cycle), the EEPROM's useful lifetime will exceed that needed for even the above described worst-case dishwasher.

ALTERNATE EMBODIMENTS

Figure 7:
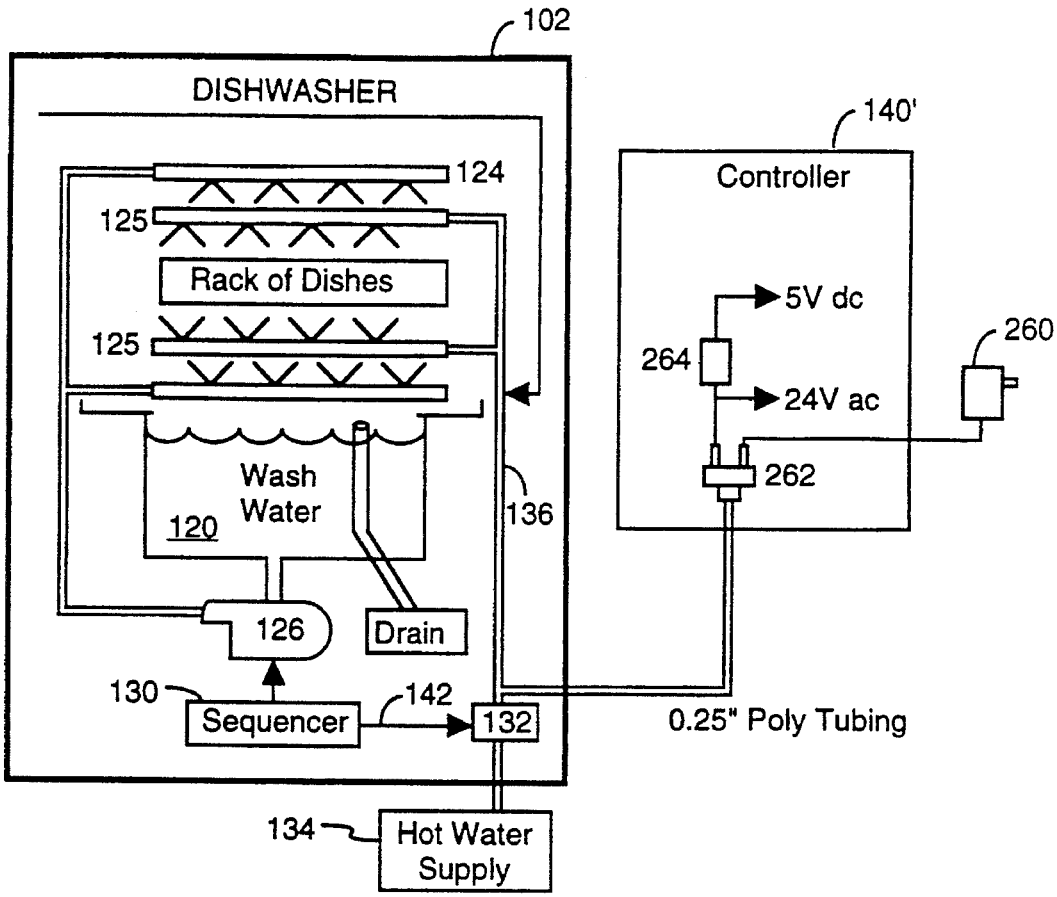
FIG. 7 is a block diagram of the interconnections between a dishwasher and the controller of a liquid chemical dispenser in an alternate preferred embodiment.

In an alternate preferred embodiment, shown in FIG. 7, power is provided to the controller 140 as follows. A first transformer 260 converts power from a separate power supply, such as from a standard 120 volt a.c. wall outlet, into a 24 volt a.c. signal. A normally open pressure switch 262 is coupled between the 24 volt a.c. signal from the first transformer 260 and other circuitry in the controller 140' via node 264. The gate of the pressure switch 262 is coupled to the rinse water line 136 (e.g., by 0.25 inch poly tubing) such that the switch 262 is closed when rinse water line 136 is under pressure from the hot water supply, and is open otherwise. Thus, the controller 140' receives power when the rinse water line 136 is pressured (from the hot water supply). The power connection is turned off by the pressure switch 262 when the rinse water line 136 is not under pressure from the hot water supply. The 24 volt a.c. power provided by the switch 262 is used directly to power the pumps, and is converted by a transformer/rectifier circuit 262 into 5 volts d.c. for the controller circuitry.

In other embodiments it would be possible for the controller 140 and pumps to always be supplied with power (such as by a 120 volt a.c. small outlet converter) and to use the rinse water solenoid signal on line 142 (or a pressure derived signal) solely as a logical signal, (indicating that rinse water is flowing into the dishwasher) instead of as a power source.

Figure 8:
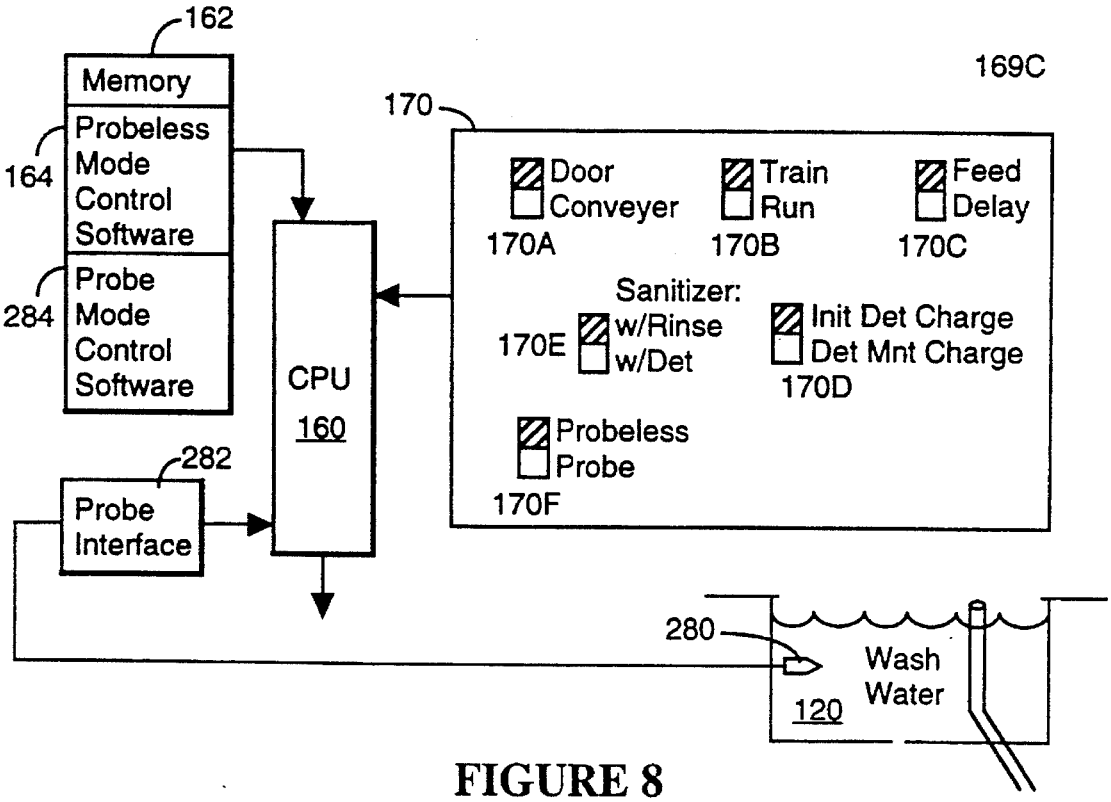
FIG. 8 is a partial block diagram of an alternate preferred embodiment of the liquid chemical dispenser controller of the present invention.

Referring to FIG. 8, in an alternate preferred embodiment, the same pump controller is used for both probeless and probed systems. To incorporate this additional modality into the system described above, an additional mode switch 170F is added to the set of mode control switches 170. In a first position mode switch 170F indicates the system is probeless, and in the other position it indicates that the detergent concentration is to be controlled using a wash water tank probe 280. When the mode switch 170F is in the "probeless" position, the control software 164 operates as described above.

When the control system includes a probe 280, mode switch 170F is set in the "probe" position. The probe 280 ,generates conductivity level (or detergent concentration level) indicating signals that are received by the CPU 180 via a probe interface 282. Furthermore, memory 162 contains additional control software 284 for operating the pumps when the mode switch 170F indicates that the system has a probe. As is known to those skilled in the art, this additional control software 284 runs the detergent pump as required to maintain a preset detergent concentration level. In all other respects, the control software 284 works as described above. For an example of control software for running a detergent pump based on signals from a conductivity probe see U.S. Pat. No. 4,756,321 (Livingston et al.).

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A liquid chemical dispensing system for dispensing a plurality of liquid chemicals into a dishwasher having a wash tank, comprising:

a plurality of pumps, including a detergent pump that pumps detergent into the wash water tank in said dishwasher and a rinse agent pump that pumps rinse agent into a rinse water line in said dishwasher;

a first switch indicating said dishwasher's type, said first switch having a first position indicating said dishwasher is a door type dishwasher and a second position indicating said dishwasher is a conveyor type dishwasher;

a second switch having a training mode position and run mode position;

an electronic non-volatile memory;

means for activating said system only when said dishwasher is spraying rinse water;

data processing means coupled to said non-volatile memory, said plurality of pumps, and said first and second switches, for controlling operation of said plurality of pumps; said data processing means including:

training mode means, enabled when said second switch is in the training mode position, for enabling a user to set values for a rinse run time parameter, a detergent run time parameter, and a rinse delay time and for storing said parameters in said non-volatile memory;

door type run mode means, enabled when said second switch is in the run mode position and said first switch is in the first position, for running said detergent and rinse pumps each time said system is activated, including: (A) running said detergent pump a length of time corresponding to said detergent run time parameter, (B) delaying running said rinse pump, from the time of each activation of said system, by an amount of time corresponding to said rinse delay time parameter, and then (C) running said rinse pump a length of time corresponding to said rinse run time parameter; and conveyor type run mode means, enabled when said second switch is in the run mode position and said first switch is in the second position, for running said rinse pump each time said system is activated, and for running said detergent pump with an on/off duty cycle determined by said detergent run time parameter.

2. The liquid chemical dispensing system of claim 1, said non-volatile memory storing a rinse run time value;

said conveyor type run mode means including rinse run time tracking means for retrieving from said non-volatile memory the rinse run time value stored therein each time that said system is activated, periodically updating said rinse run time value, and running said detergent pump at times determined in accordance with said rinse run time value and said detergent run time parameter; said conveyor type run means further including means for storing said updated rinse run time value in said non-volatile memory.

3. The liquid chemical dispensing system of claim 2, said rinse run time tracking means including means for running said detergent pump for N seconds for each M seconds that said rinse pump is run, where N is said detergent run time parameter and M is larger than N.

4. The liquid chemical dispensing system of claim 2, said non-volatile memory storing specified values at specified locations in said non-volatile memory;

said rinse run time tracking means including non-volatile memory management means for (A) storing in said non-volatile memory a pointer indicating a location in said non-volatile memory where said updated rinse run time value is stored, (B) storing in said non-volatile memory at another location corresponding to said pointer an update data value indicating how many times said updated rinse run time value has been stored in said non-volatile memory, and (C) storing in said non-volatile memory an updated pointer, indicating a different location in said non-volatile memory than the location previously indicated by said stored pointer, when said update data value reaches a threshold value stored by said controller.

5. The liquid chemical dispensing system of claim 1, said training mode means further including means for enabling a user to set a second detergent run time parameter;

said system further including a detergent pump prime button for user activation whenever said dishwasher's water tank is refilled; and said data processor means further including detergent refill means for responding to user activation of said detergent pump prime button by running said detergent pump a length of time corresponding to said second detergent run time parameter.

6. A liquid chemical dispensing system for dispensing a plurality of liquid chemicals into a conveyor dishwasher having a wash water tank, wherein said dishwasher is configured to spray rinse water on dishware and to route used rinse water into said dishwasher's wash water tank, the liquid chemical dispensing system comprising:

a plurality of chemical dispensers, including a detergent dispenser that dispenses detergent into the wash water tank in said dishwasher and a rinse agent dispenser that dispenses rinse agent into a rinse water line in said dishwasher;

a controller having a programmed digital data processor for running said plurality of dispensers; and an electronic non-volatile memory;

said controller coupled to said non-volatile memory and including a digital processor programmed to:

detect when said dishwasher is spraying rinse water;

run said rinse agent dispenser whenever said dishwasher is spraying rinse water;

generate and periodically increment a rinse run time value so long as said dishwasher continues to spray rinse water such that said rinse run time value is indicative of how long said dishwasher has been spraying rinse water;

store in said electronic non-volatile memory said rinse run time value each time said dishwasher stops spraying rinse water;

retrieve from said non-volatile memory, each time said dishwasher begins to spray rinse water, said rinse run time value stored therein, and then resume periodically incrementing said rinse run time value; and run said detergent dispenser at times determined in accordance with said rinse run time value such that said detergent dispenser is running a portion of the time that said dishwasher sprays rinse water and is otherwise turned off, wherein said portion is determined by a detergent run time parameter stored by said controller;

whereby detergent is dispensed into said dishwasher's wash water tank in amounts corresponding to the amount of time that said dishwasher sprays rinse water.

7. The liquid chemical dispenser of claim 6, wherein said controller is coupled to said dishwasher so that said controller is powered on only when said dishwasher is spraying rinse water.

8. The liquid chemical dispenser of claim 7, wherein said data processor is programmed to run said detergent dispenser for N seconds for each M seconds that said rinse dispenser is run, where N is said detergent run time parameter and M is larger than N.

9. The liquid chemical dispenser of claim 6, wherein said data processor is programmed to:

store in said non-volatile memory a pointer indicating a location in said non-volatile memory where said updated rinse run time value is stored;

store in said non-volatile memory at another location corresponding to said pointer an update data value indicating how many times said updated rinse run time value has been stored in said non-volatile memory; and store in said non-volatile memory an updated pointer, indicating a different location in said non-volatile memory than the location previously indicated by said stored pointer, when said update data value reaches a threshold value stored by said controller.

10. A liquid chemical dispensing system for dispensing a plurality of liquid chemicals into a conveyor dishwasher having a wash water tank, wherein said dishwasher is configured to route used rinse water into said dishwasher's wash water tank, the liquid chemical dispensing system comprising:

a plurality of dispensers, including a detergent dispenser that dispenses detergent into the wash water tank in said dishwasher and a rinse agent dispenser that dispenses rinse agent into a rinse water line in said dishwasher;

a controller having a programmed digital data processor for running said plurality of dispensers; and an electronic non-volatile memory;

said controller coupled to said non-volatile memory and including a digital processor programmed to:

detect when said dishwasher is spraying rinse water;

generate and periodically increment a rinse run time value so long as said dishwasher continues to spray rinse water such that said rinse run time value is indicative of how long said dishwasher has been spraying rinse water;

each time said dishwasher begins to spray rinse water, resume periodically incrementing said rinse run time value; and running said detergent dispenser at times determined in accordance with said rinse run time value so that said detergent dispenser is running a portion of the time that said dishwasher sprays rinse water and is otherwise turned off, wherein said portion is determined by a detergent run time parameter stored by said controller;

whereby detergent is dispensed into said dishwasher's wash water tank in amounts corresponding to the amount of time that said dishwasher sprays rinse water.

11. A liquid chemical dispensing system for dispensing a plurality of liquid chemicals into a door dishwasher having a wash water tank and at least one dispenser, wherein said dishwasher is configured to route used rinse water into said dishwasher's wash water tank, the liquid chemical dispensing system comprising:

at least one dispenser, including a detergent dispenser that dispenses detergent into said wash water tank in said dishwasher, a controller having a programmed digital data processor for running said at least one dispenser, wherein said digital data processor is programmed to:

establish a first detergent run time parameter;

detect when said dishwasher is spraying rinse water;

initialize a rinse run time value whenever said dishwasher begins to spray rinse water, and periodically increment said rinse run time value so long as said dishwasher continues to spray rinse water such that said rinse run time value is indicative of how long said dishwasher has been spraying rinse water;

each time said dishwasher begins to spray rinse water, run said detergent dispenser a length of time corresponding to said first detergent run time parameter; and detect when said rinse run time value exceeds a threshold value, and then run said detergent dispenser so as to dispense additional detergent into said dishwasher;

wherein said threshold value is set so that said rinse run time value exceeds said threshold value only when said wash water tank is being refilled; whereby said wash water tank is automatically recharged with detergent whenever said wash water tank is refilled.

12. The liquid chemical dispenser of claim 11, wherein said data processor is further programmed to:

establish a second detergent run time parameter; and after detecting when said rinse run time value exceeds said threshold value, run said detergent dispenser a length of time corresponding to said second detergent run time parameter.

13. The liquid chemical dispenser of claim 11, wherein said controller is coupled to said dishwasher so that said controller is powered on only when said dishwasher is spraying rinse water.

* * * * *